US009466450B2

(12) United States Patent
Takaya et al.

(10) Patent No.: US 9,466,450 B2
(45) Date of Patent: Oct. 11, 2016

(54) ELECTROMAGNETIC CONTACTOR HAVING A CONTACT NOISE SUPPRESSION MEMBER

(71) Applicants: FUJI ELECTRIC FA COMPONENTS & SYSTEMS CO., LTD., Chuo-ku, Tokyo (JP); FUJI ELECTRIC CO., LTD., Kawasaki-shi, Kanagawa (JP)

(72) Inventors: Kouetsu Takaya, Kounosu (JP); Yasuhiro Naka, Kounosu (JP); Kenji Suzuki, Kounosu (JP); Masayoshi Sakata, Yokohama (JP)

(73) Assignees: FUJI ELECTRIC FA COMPONENTS & SYSTEMS CO., LTD., Tokyo (JP); FUJI ELECTRIC CO., LTD., Kawasaki-Shi (JP)

( * ) Notice: Subject to any disclaimer, the term of this patent is extended or adjusted under 35 U.S.C. 154(b) by 106 days.

(21) Appl. No.: 14/505,719

(22) Filed: Oct. 3, 2014

(65) Prior Publication Data

US 2015/0022295 A1 Jan. 22, 2015

Related U.S. Application Data

(63) Continuation of application No. PCT/JP2013/002473, filed on Apr. 11, 2013.

(30) Foreign Application Priority Data

Apr. 13, 2012 (JP) ..... 2012-092450

(51) Int. Cl.
*H01H 50/34* (2006.01)
*H01H 50/16* (2006.01)
(Continued)

(52) U.S. Cl.
CPC ..... *H01H 50/34* (2013.01); *H01H 50/163* (2013.01); *H01H 50/305* (2013.01); *H01H 50/60* (2013.01);
(Continued)

(58) Field of Classification Search
CPC .. H01H 50/163; H01H 50/305; H01H 50/34; H01H 50/60; H01H 50/648
See application file for complete search history.

(56) References Cited

U.S. PATENT DOCUMENTS 5,892,194 A 4/1999 Uotome et al.
8,138,863 B2 3/2012 Tanaka et al.
(Continued)

FOREIGN PATENT DOCUMENTS

CN 101167151 A 4/2008
CN 201171024 Y 12/2008
(Continued)

OTHER PUBLICATIONS

PCT, "International Search Report for International Application No. PCT/JP2013/002473".
(Continued)

*Primary Examiner* — Bernard Rojas
(74) *Attorney, Agent, or Firm* — Manabu Kanesaka

(57) ABSTRACT

The electromagnetic contactor includes a contact mechanism including a pair of fixed contacts disposed to maintain a predetermined interval and a movable contact disposed so as to connect to and separate from the pair of fixed contacts, and an electromagnet unit that drives the movable contact. The electromagnet unit includes a magnetic yoke enclosing a plunger drive portion, a movable plunger, a leading end thereof protruding through an aperture formed in the magnetic yoke and a peripheral flange portion being formed on a protruding end side, movement regulating portions that regulate movement of the peripheral flange portion of the movable plunger in an engaged position and released position of the contact mechanism, and a contact noise suppression member that suppresses contact noise when the peripheral flange portion of the movable plunger contacts the movement regulating portions.

8 Claims, 8 Drawing Sheets

(51) Int. Cl.

| | |
|---|---|
| ***H01H 50/30*** | (2006.01) |
| ***H01H 50/60*** | (2006.01) |
| ***H01H 50/64*** | (2006.01) |
| *H01H 1/54* | (2006.01) |
| *H01H 50/42* | (2006.01) |
| *H01H 50/54* | (2006.01) |
| *H01H 50/02* | (2006.01) |
| *H01H 50/22* | (2006.01) |

(52) U.S. Cl.
CPC ..... *H01H 50/648* (2013.01); *H01H 1/54* (2013.01); *H01H 50/22* (2013.01); *H01H 50/42* (2013.01); *H01H 50/546* (2013.01); *H01H 2050/025* (2013.01)

(56) References Cited

U.S. PATENT DOCUMENTS

| | | | | |
|---|---|---|---|---|
| 2004/0056743 | A1* | 3/2004 | Maruhashi | F02N 15/063 335/126 |
| 2009/0243771 | A1* | 10/2009 | Uruma | H01H 50/04 335/193 |
| 2009/0284335 | A1 | 11/2009 | Kim et al. | |
| 2012/0092102 | A1* | 4/2012 | Eum | H01H 51/065 335/193 |
| 2013/0088312 | A1 | 4/2013 | Isonaga | |

FOREIGN PATENT DOCUMENTS

| | | | | |
|---|---|---|---|---|
| CN | 101582351 | A | 11/2009 | |
| CN | 101620951 | A | 1/2010 | |
| GB | 2229039 | A | 9/1990 | |
| JP | 3107288 | B | 11/2000 | |
| JP | 2004-355846 | A | 12/2004 | |
| JP | 2008-146874 | A | 6/2008 | |
| JP | WO 2011161919 | A1 * | 12/2011 | H01H 50/20 |
| JP | 2012-028310 | A | 2/2012 | |

OTHER PUBLICATIONS

China Patent Office, "Office Action for CN 201380019183.5," Oct. 23, 2015.
Europe Patent Office, "Search Report for EP 13775836.3," Nov. 17, 2015.
China Patent Office, "Office Action for Chinese Patent Application No. 201380019183.5," Jun. 24, 2016.

* cited by examiner

ELECTROMAGNETIC CONTACTOR HAVING A CONTACT NOISE SUPPRESSION MEMBER

CROSS REFERENCE TO RELATED APPLICATION

The present application is a continuation application of an International Application No. PCT/JP2013/002473 filed Apr. 11, 2013, and claims priority from Japanese Application No. 2012-092450 filed Apr. 13, 2012.

TECHNICAL FIELD

The present invention relates to an electromagnetic contactor including fixed contacts, a movable contact attachable to and detachable from the fixed contacts, and an electromagnet unit that drives the movable contact.

BACKGROUND ART

An electromagnetic contactor that carries out switching of a current path includes a movable contact driven by an exciting coil and movable plunger of an electromagnet unit. That is, when the exciting coil is in a non-exciting state, the movable plunger is biased by a return spring, creating a released state wherein the movable contact is separated from a pair of fixed contacts disposed to maintain a predetermined interval. By exciting the exciting coil in the released state, the movable plunger is moved against the return spring, and the movable contact contacts with the pair of fixed contacts, creating an engaged state (for example, refer to PTL 1).

CITATION LIST

Patent Literature

PTL 1: Japanese Patent No. 3,107,288

SUMMARY OF INVENTION

Technical Problem

However, in the heretofore known example described in PTL 1, when changing from an engaged state to a released state, an arc is generated between the fixed contacts and the movable contact. In order to reliably extinguish the arc when switching a current path along which a large current of in the region of, for example, several tens to several hundreds of amps flows, it is necessary that there is a long distance between the fixed contacts and movable contact in a released state, and that the return spring for changing from an engaged state to a released state has a large biasing force. Consequently, it is necessary to increase the electromagnetic force generated in the electromagnet unit that drives the movable plunger, and there is an unresolved problem that a loud contact noise is emitted when the movable plunger moves the contact mechanism to an engaged position or released position.

Therefore, the invention, focusing on the unresolved problem of the heretofore known example, has an object of providing an electromagnetic contactor to suppress an emission of contact noise at least when a movable plunger moves a contact mechanism to an engaged position.

Solution to Problem

In order to achieve the object, one aspect of an electromagnetic contactor according to the invention includes a contact mechanism including a pair of fixed contacts disposed to maintain a predetermined interval and a movable contact disposed so as to connect to and separate from the pair of fixed contacts, and an electromagnet unit that drives the movable contact. Further, the electromagnet unit includes a magnetic yoke enclosing a plunger drive portion, a movable plunger, a leading end of the movable plunger protruding through an aperture formed in the magnetic yoke and a peripheral flange portion being formed at a protruding end side, a movement regulating portion that regulates movement of the peripheral flange portion of the movable plunger in an engaged position and released position of the contact mechanism, and a contact noise suppression member that suppresses contact noise when the peripheral flange portion of the movable plunger contacts the movement regulating portion.

According to this first aspect, the movement range of the movable plunger is regulated by the peripheral flange portion formed on the movable plunger contacting a movement regulating portion, but contact noise emitted when the peripheral flange portion of the movable plunger contacts the movement regulating portion can be suppressed by the contact noise suppression member, thus improving quietness.

Also, in a second aspect of the electromagnetic contactor according to the invention, the contact noise suppression member includes an elastic body disposed in the movement regulating portion and contacting the peripheral flange portion of the movable plunger.

According to the second aspect, when the movable plunger contacts the movement regulating portion when moving the contact mechanism to an engaged position or released position, an emission of contact noise can be suppressed by the elastic body contacting the peripheral flange portion of the movable plunger.

Also, in a third aspect of the electromagnetic contactor according to the invention, the elastic body is disposed in a ring form inside the aperture formed in the magnetic yoke.

According to the third aspect, the elastic body is disposed in the ring form inside the aperture in the magnetic yoke through which the movable plunger is inserted, thereby, the elastic body contacts the whole periphery of the peripheral flange portion of the movable plunger, and it is thus possible to reliably prevent an emission of contact noise.

Also, in a fourth aspect of the electromagnetic contactor according to the invention, the elastic body has protruding portions disposed to maintain predetermined intervals in a circumferential direction on a surface that contacts the peripheral flange portion of the movable plunger.

According to the fourth aspect, protruding portions disposed to maintain predetermined intervals in a circumferential direction are formed on the surface of the elastic body that contacts the peripheral flange portion of the movable plunger, and the peripheral flange portion of the movable plunger contacts the protruding portions. Thereby, it is possible for the protruding portions to be soft, thus more reliably preventing an emission of contact noise.

Also, in a fifth aspect of the electromagnetic contactor according to the invention, the contact noise suppression member includes an elastic body interposed between a movement regulating plate slidably disposed in an axial direction inside the aperture of the magnetic yoke and a fixed member that regulates a position of the movement regulating plate in the axial direction.

According to the fifth aspect, it is possible to apply an elastic body such as an O-ring, and thus possible to form the elastic body at low cost, without any need to form an elastic body of a special form.

Also, in a sixth aspect of the electromagnetic contactor according to the invention, the movable plunger includes the peripheral flange portion disposed so as to be movable in an axial direction, and the contact noise suppression member includes elastic rings that individually support two ends of the peripheral flange portion in the axial direction.

According to the sixth aspect, the movable plunger and peripheral flange portion are separated, and elastic bodies are disposed on the two sides of the peripheral flange portion in the axial direction, thereby, it is possible to suppress contact noise in both an engaged position and released position of the contact mechanism. In this case, it is possible to apply a simple configuration such as an O-ring as the elastic bodies, and there is thus no need to use elastic bodies of a special form.

Advantageous Effects of Invention

According to the invention, when contacting with a movement regulating member that, at least in an engaged position, regulates the movement position of a movable plunger that causes a movable contact of a contact mechanism to move to an engaged position wherein the movable contact contacts fixed contacts and a released position wherein the movable contact is separated from the fixed contacts, a contact noise emitted when a peripheral flange portion of the movable plunger contacts with the movement regulating member can be suppressed with a contact noise suppression member, thus improving quietness.

BRIEF DESCRIPTION OF DRAWINGS

FIGS. 2A, 2B and 2C are diagrams, each showing an insulating cover of a contact device, wherein FIG. 2A is a perspective view, FIG. 2B is a plan view before mounting, and FIG. 2C is a plan view after mounting.

FIGS. 5A and 5B are diagrams, each illustrating a movable plunger suctioning action by the permanent magnet, wherein FIG. 5A is a partial sectional view showing a released state and FIG. 5B is a partial sectional view showing an engaged state.

FIGS. 8A, 8B and 8C are diagrams, each showing an electromagnet unit of a second embodiment of the invention, wherein FIG. 8A is an exploded perspective view, FIG. 8B is a sectional view showing a released state, and FIG. 8C is a sectional view showing an engaged state.

FIGS. 9A, 9B and 9C are diagrams, each showing an electromagnet unit of a third embodiment of the invention, wherein FIG. 9A is an exploded perspective view, FIG. 9B is a sectional view showing a released state, and FIG. 9C is a sectional view showing an engaged state.

DESCRIPTION OF EMBODIMENTS

Hereafter, a description will be given, based on the drawings, of embodiments of the invention.

Figure 1:
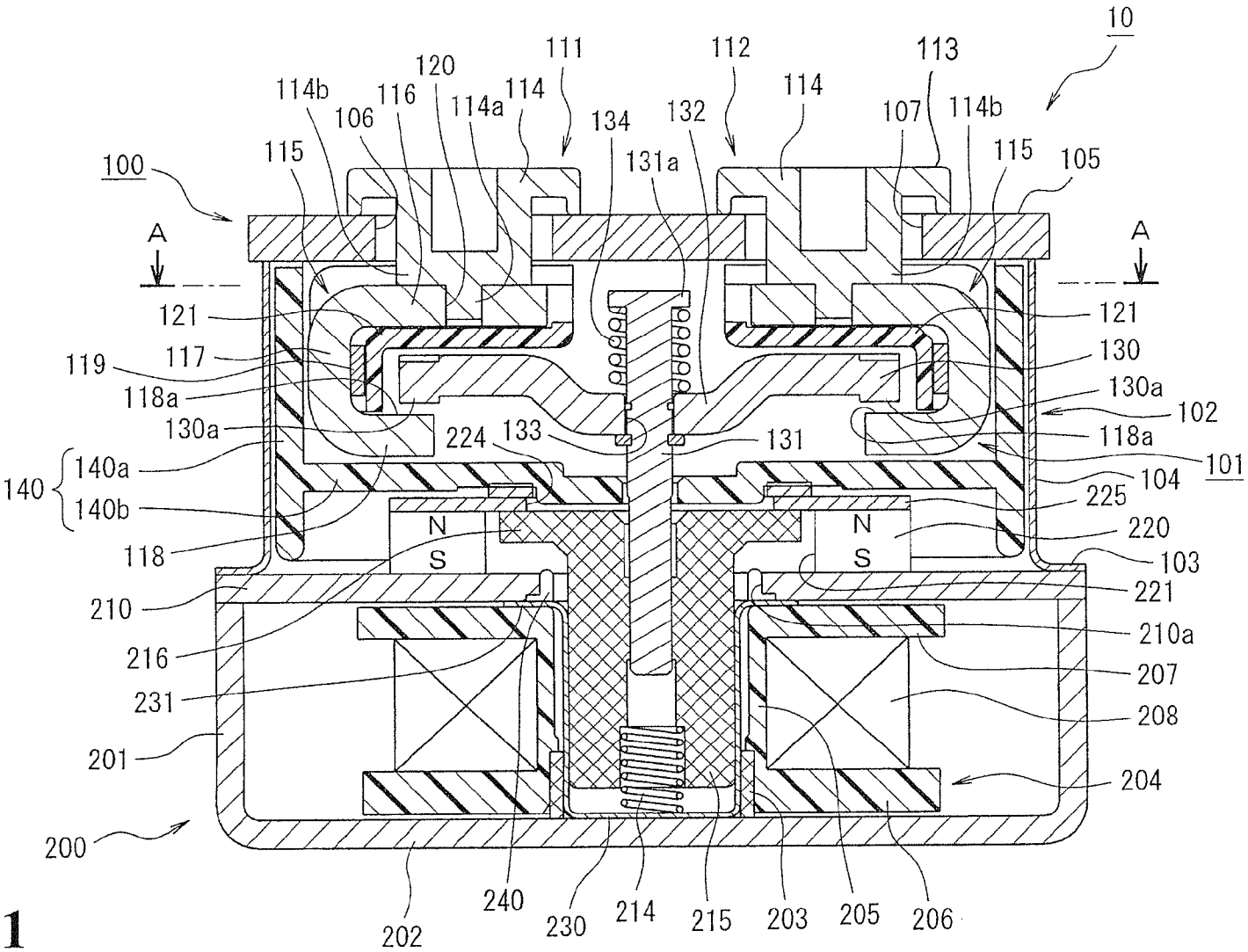
FIG. 1 is a sectional view showing an embodiment of an electromagnetic contactor according to the invention.

FIG. 1 is a sectional view showing one example of an electromagnetic contactor according to the invention. In FIG. 1, is an electromagnetic contactor, and the electromagnetic contactor 10 includes a contact device 100 in which a contact mechanism is disposed, and an electromagnet unit 200 that drives the contact device 100.

The contact device 100 has an arc extinguishing chamber 102 that houses a contact mechanism 101, as clearly shown in FIG. 1. The arc extinguishing chamber 102 includes a metal tubular body 104 having a flange portion 103 arranged on a metal lower end portion and protruding outward, and a fixed contact support insulating substrate 105 formed of a plate-like ceramic insulating substrate that closes off the upper end of the metal tubular body 104.

The metal tubular body 104 is formed such that the flange portion 103 thereof is seal joined and fixed to an upper magnetic yoke 210 of the electromagnet unit 200, to be described hereafter.

Also, through holes 106 and 107 in which a pair of fixed contacts 111 and 112 is inserted, to be described hereafter, are formed to maintain a predetermined interval in a central portion of the fixed contact support insulating substrate 105. A metalizing process is performed around the through holes 106 and 107 on the upper surface side of the fixed contact support insulating substrate 105, and in a position on the lower surface side that contacts the tubular body 104. In order to carry out the metalizing process, copper foil is formed around the through holes 106 and 107, and in the position that contacts the tubular body 104, in a state wherein a plurality of the fixed contact support insulating substrate 105 is arranged vertically and horizontally on a flat surface.

The contact mechanism 101, as shown in FIG. 1, includes the pair of fixed contacts 111 and 112 inserted into and fixed in the through holes 106 and 107 of the fixed contact support insulating substrate 105 of the arc extinguishing chamber 102. Each of the fixed contacts 111 and 112 includes a support conductor portion 114, having the flange portion 113 arranged on an upper end and protruding outward, inserted into the through holes 106 and 107 of the fixed contact support insulating substrate 105, and a C-shaped portion 115, the inner side of which is opened, linked to the support conductor portion 114 and disposed on the lower surface side of the fixed contact support insulating substrate 105.

The C-shaped portion 115 is formed in a C-shape of an upper plate portion 116 extending to the outer side along the line of the lower surface of the fixed contact support insulating substrate 105, an intermediate plate portion 117 extending downward from the outer side end portion of the upper plate portion 116, and a lower plate portion 118 extending from the lower end side of the intermediate plate portion 117, parallel with the upper plate portion 116, to the inner side, that is, in a direction facing the fixed contacts 111 and 112, wherein the upper plate portion 116 is added to an L-shape formed by the intermediate plate portion 117 and lower plate portion 118.

Herein, the support conductor portion 114 and C-shaped portion 115 are fixed by, for example, brazing in a state in which a pin 114*a* protruding on the lower end surface of the support conductor portion 114 is inserted into a through hole

120 formed in the upper plate portion 116 of the C-shaped portion 115. The fixing of the support conductor portion 114 and C-shaped portion 115, not being limited to brazing, may be such that the pin 114*a* is fitted into the through hole 120, or an external thread is formed on the pin 114*a* and an internal thread formed in the through hole 120, and the two are screwed together.

Further, an insulating cover 121, made of a synthetic resin material, that regulates arc generation is mounted on the C-shaped portion 115 of each of the fixed contacts 111 and 112. The insulating cover 121 covers the inner peripheral surfaces of the upper plate portion 116 and intermediate plate portion 117 of the C-shaped portion 115, as shown in FIGS. 2A to 2C.

The insulating cover 121 includes an L-shaped plate portion 122 that extends along the inner peripheral surfaces of the upper plate portion 116 and intermediate plate portion 117, side plate portions 123 and 124, each extending upward and outward from front and rear end portions of the L-shaped plate portion 122, that cover side surfaces of the upper plate portion 116 and intermediate plate portion 117 of the C-shaped portion 115, and a fitting portion 125, formed on the inward side from the upper end of the side plate portions 123 and 124, that fits onto a small diameter portion 114*b* formed on the support conductor portion 114 of each of the fixed contacts 111 and 112.

Figure 2A:
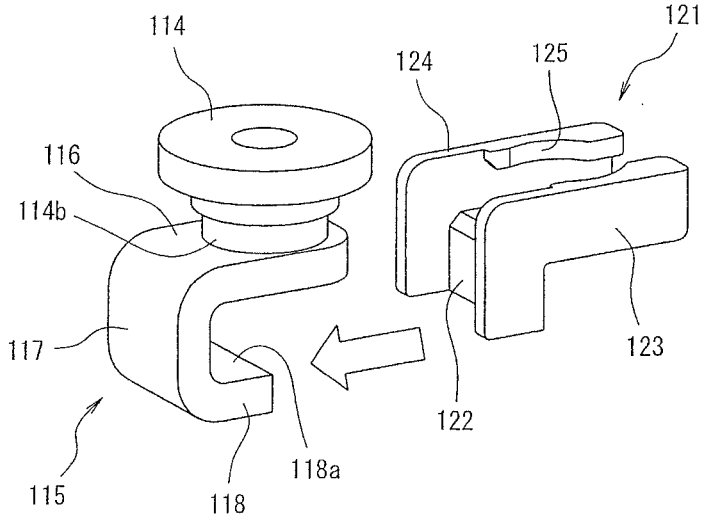
Figure 2B:
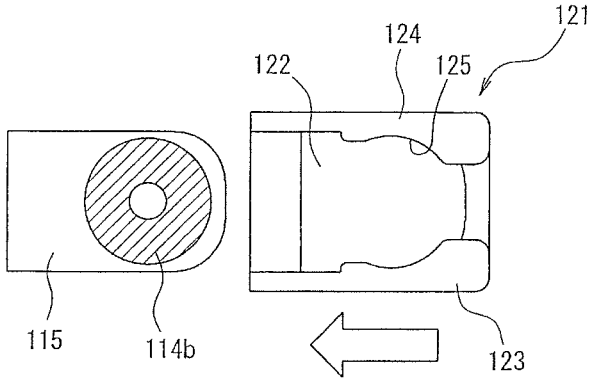
Figure 2C:
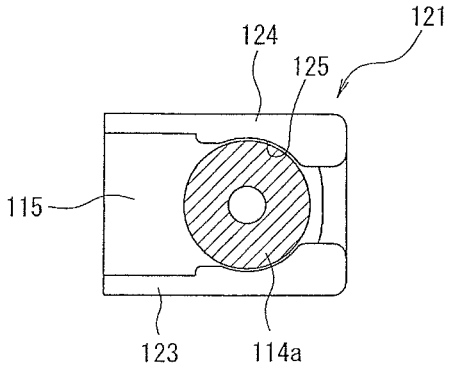

Consequently, the insulating cover 121 is placed in a state in which the fitting portion 125 is facing the small diameter portion 114*b* of the support conductor portion 114 of each of the fixed contacts 111 and 112, as shown in FIGS. 2A and 2B, thereafter, the fitting portion 125 is fitted onto the small diameter portion 114*b* of the support conductor portion 114 by pushing the insulating cover 121 onto the small diameter portion 114*b*, as shown in FIG. 2C.

Figure 3A:
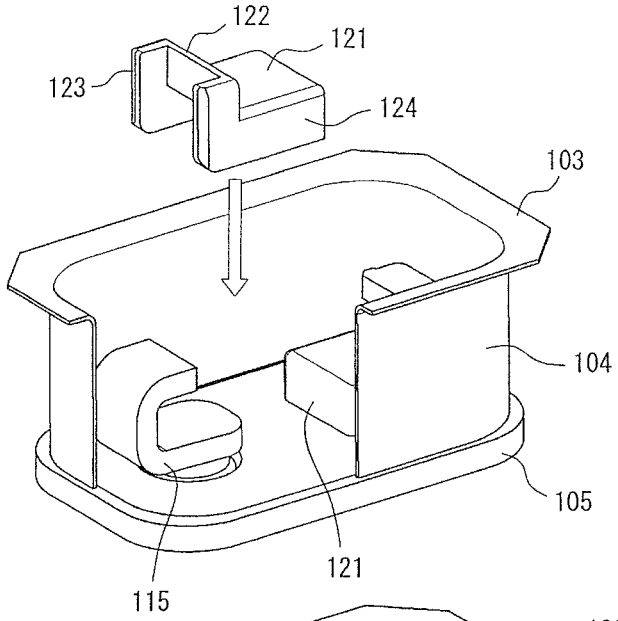
FIGS. 3A, 3B and 3C are illustrations, each showing an insulating cover mounting method.

Actually, as shown in FIG. 3A, with the arc extinguishing chamber 102 after the fixed contacts 111 and 112 have been attached in a state wherein the fixed contact support insulating substrate 105 is placed on the lower side, the insulating cover 121 is inserted from an upper aperture portion between the fixed contacts 111 and 112 in a state vertically reversed from the state shown in FIGS. 2A to 2C.

Figure 3B:
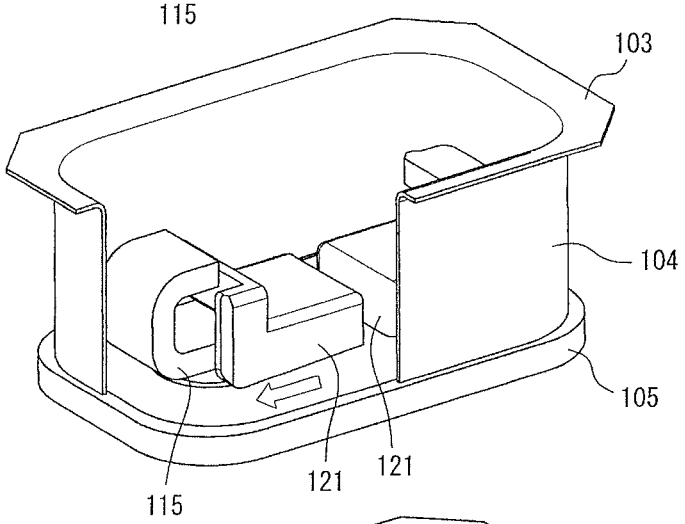
Figure 3C:
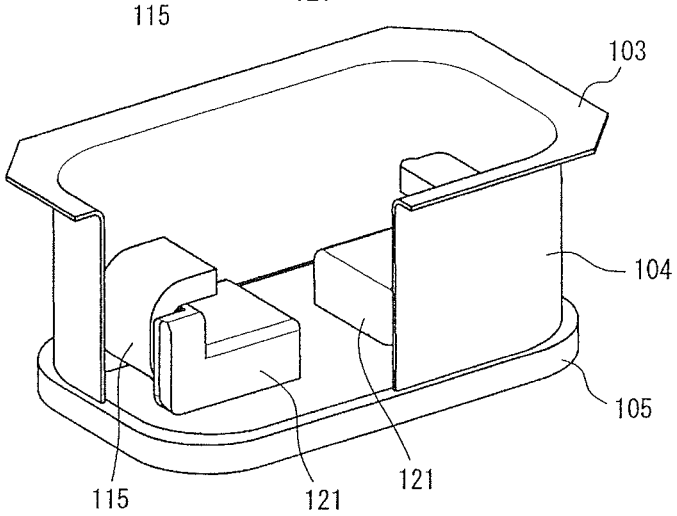

Next, in a state in which the fitting portion 125 contacts the fixed contact support insulating substrate 105, as shown in FIG. 3B, the fitting portion 125 is engaged with and fixed to the small diameter portion 114*b* of the support conductor portion 114 of each of the fixed contacts 111 and 112 by pushing the insulating cover 121 to the outer side, as shown in FIG. 3C.

By mounting the insulating cover 121 on the C-shaped portion 115 of each of the fixed contacts 111 and 112 in this way, only the upper surface side of the lower plate portion 118 of the inner peripheral surface of the C-shaped portion 115 is exposed, and forms a contact portion 118*a*.

Further, the movable contact 130 is disposed such that the two end portions thereof are disposed in the C-shaped portions 115 of the fixed contacts 111 and 112. The movable contact 130 is supported by a coupling shaft 131 fixed to a movable plunger 215 of the electromagnet unit 200, to be described hereafter. The movable contact 130 is formed such that a central portion in the vicinity of the coupling shaft 131 protrudes downward, whereby a depressed portion 132 is formed, and a through hole 133 in which the coupling shaft 131 is inserted is formed in the depressed portion 132.

A flange portion 131*a* protruding outward is formed on the upper end of the coupling shaft 131. The coupling shaft 131 is inserted from the lower end side into a contact spring 134, then inserted into the through hole 133 of the movable contact 130, bringing the upper end of the contact spring 134 into contact with the flange portion 131*a*, and the movable contact 130 is positioned by, for example, a C-ring 135 so as to obtain a predetermined biasing force from the contact spring 134.

The movable contact 130, in a released position, is in a state wherein the two ends of the contact portions and the contact portions 118*a* of the lower plate portions 118 of the C-shaped portions 115 of the fixed contacts 111 and 112 are separated from each other to maintain a predetermined interval. Also, the movable contact 130 is set such that, in an engaged position, the two ends of the contact portions contact the contact portions 118*a* of the lower plate portions 118 of the C-shaped portions 115 of the fixed contacts 111 and 112 at a predetermined contact pressure from the contact spring 134.

The electromagnet unit 200, as shown in FIG. 1, has a magnetic yoke 201 of a flattened U-shape relative to the side direction, and a cylindrical auxiliary yoke 203 is fixed in a central portion of a bottom plate portion 202 of the magnetic yoke 201. A spool 204 is disposed as a plunger drive portion on the outer side of the cylindrical auxiliary yoke 203.

The spool 204 includes a central cylinder portion 205 in which the cylindrical auxiliary yoke 203 is inserted, a lower flange portion 206 protruding outward in a radial direction from a lower end portion of the central cylinder portion 205, and an upper flange portion 207 protruding outward in a radial direction from slightly below the upper end of the central cylinder portion 205. Further, an exciting coil 208 is mounted and wound in a housing space formed by the central cylinder portion 205, lower flange portion 206, and upper flange portion 207.

Further, the upper magnetic yoke 210 is fixed between upper ends forming an opened end of the magnetic yoke 201. A through hole 210*a* facing the central cylinder portion 205 of the spool 204 is formed in a central portion of the upper magnetic yoke 210.

Further, the movable plunger 215, in which a return spring 214 is disposed between a bottom portion and the bottom plate portion 202 of the magnetic yoke 201, is disposed in the central cylinder portion 205 of the spool 204 so as to be capable to slide up and down. A peripheral flange portion 216 protruding outward in a radial direction is formed on the movable plunger 215, on an upper end portion protruding upward through the through hole 210*a* of the upper magnetic yoke 210.

Also, a permanent magnet 220 formed in a ring-form is fixed to the upper surface of the upper magnetic yoke 210 so as to enclose the peripheral flange portion 216 of the movable plunger 215. The permanent magnet 220 has a through hole 221 enclosing the peripheral flange portion 216. The permanent magnet 220 is magnetized in an up-down direction, that is, a thickness direction, such that the upper end side is, for example, an N-pole while the lower end side is an S-pole. The form of the through hole 221 of the permanent magnet 220 corresponds to the form of the peripheral flange portion 216, and the form of the outer peripheral surface can be any form, such as circular or rectangular.

Further, an auxiliary yoke 225 having the same external form as the permanent magnet 220 and a through hole 224 with an inner diameter smaller than the outer diameter of the peripheral flange portion 216 of the movable plunger 215, is fixed to the upper end surface of the permanent magnet 220. The peripheral flange portion 216 of the movable plunger 215 is opposed by the lower surface of the auxiliary yoke 225.

Figure 4:
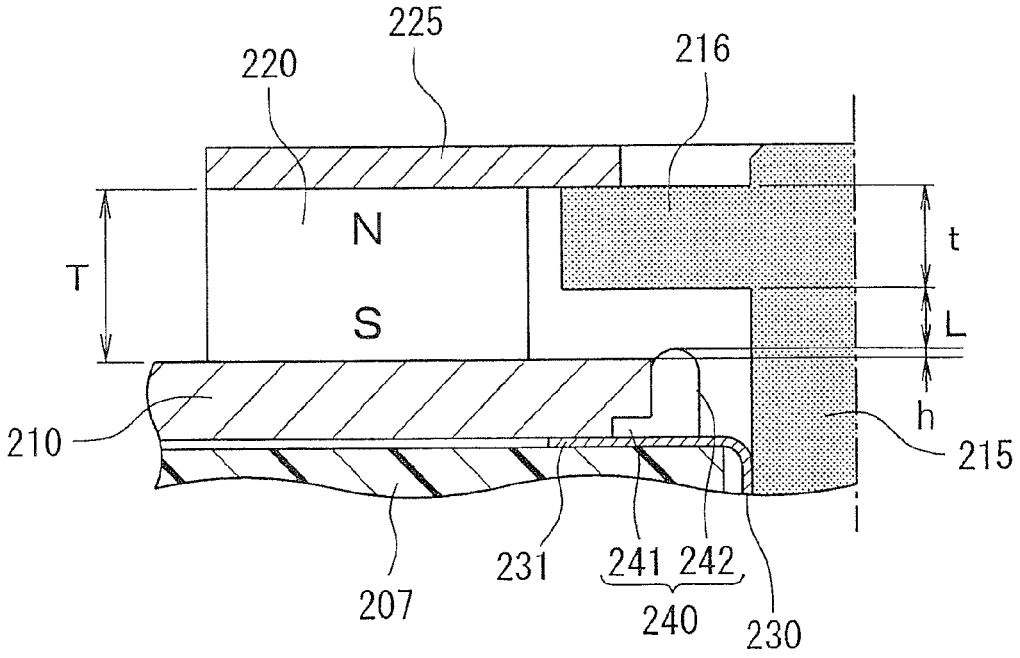
FIG. 4 is an enlarged sectional view showing the positional relationship of a permanent magnet, movable plunger, and contact noise suppression member.

Herein, a thickness T of the permanent magnet 220 is set to a value (T=L+t+h) wherein a stroke L of the movable plunger 215, a thickness t of the peripheral flange portion 216 of the movable plunger 215, and a protruding height h of a contact noise suppression member 240, to be described hereafter, are added together, as shown in FIG. 4. Consequently, the stroke L of the movable plunger 215 is practically regulated by the thickness T of the permanent magnet 220.

Because of this, the upper surface of the upper magnetic yoke 210 and the lower surface of the auxiliary yoke 225 form movement regulating members that regulate the movement (stroke) in an axial direction of the peripheral flange portion 216 of the movable plunger 215.

Because of this, it is possible to minimize the cumulative number of parts and form tolerance, which affect the stroke of the movable plunger 215. Also, it is possible to determine the stroke L of the movable plunger 215 with only the thickness T of the permanent magnet 220 and the thickness t of the peripheral flange portion 216, and thus possible to minimize variation of the stroke L. In particular, this is more advantageous in the case of a small electromagnetic contactor in which the stroke is small.

Also, as the permanent magnet 220 is formed in a ring-form, the number of parts decreases in comparison with a case in which two permanent magnets are disposed with bilateral symmetry, as described in, for example, JP-A-2-91901 and U.S. Pat. No. 5,959,519, and a reduction in cost is achieved. Also, as the peripheral flange portion 216 of the movable plunger 215 is disposed in the vicinity of the inner peripheral surface of the through hole 221 formed in the permanent magnet 220, there is no waste in a closed circuit passing magnetic flux generated by the permanent magnet 220, leakage flux decreases, and it is possible to use the magnetic force of the permanent magnet effectively.

Also, the coupling shaft 131 that supports the movable contact 130 is screwed to the upper end surface of the movable plunger 215.

Further, in the released state, the movable plunger 215 is biased upward by the return spring 214, and the upper surface of the peripheral flange portion 216 attains a released position contacting the lower surface of the auxiliary yoke 225 fixed to the upper end surface of the permanent magnet 220. In this state, the contact portions 130*a* of the movable contact 130 are moved upward from the contact portions 118*a* of the fixed contacts 111 and 112, thereby, causing a state wherein current is interrupted.

In the released state, the peripheral flange portion 216 of the movable plunger 215 is suctioned to the auxiliary yoke 225 by the magnetic force of the permanent magnet 220. Because of this, by a combination of this magnetic force and the biasing force of the return spring 214, the state in which the movable plunger 215 contacts the auxiliary yoke 225 is maintained, without unplanned downward movement due to external vibration, shock, or the like.

Figure 5A:
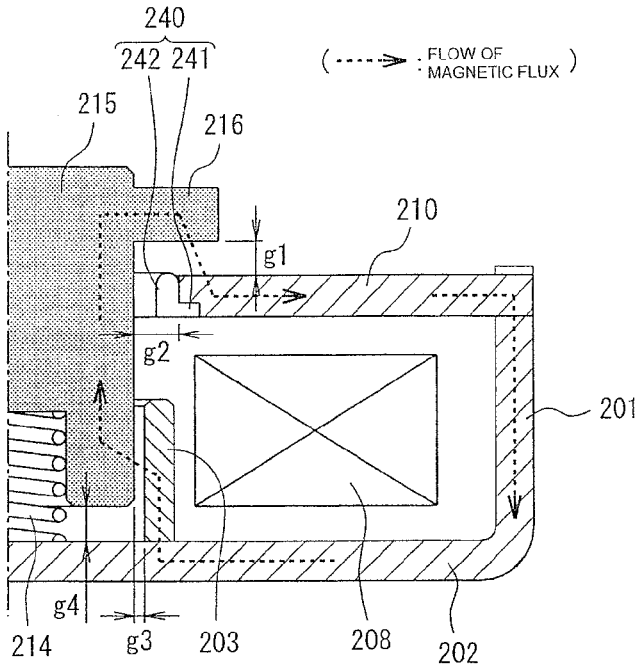

Also, in the released state, as shown in FIG. 5A, relationships between a gap g1 between the lower surface of the peripheral flange portion 216 of the movable plunger 215 and the upper surface of the upper magnetic yoke 210, a gap g2 between the outer peripheral surface of the movable plunger 215 and the through hole 210*a* of the upper magnetic yoke 210, a gap g3 between the outer peripheral surface of the movable plunger 215 and the cylindrical auxiliary yoke 203, and a gap g4 between the lower surface of the movable plunger 215 and the upper surface of the bottom plate portion 202 of the magnetic yoke 201 are set as below.

$$g1<g2 \text{ and } g3<g4$$

Because of this, when exciting the exciting coil 208 in the released state, the magnetic flux passes from the movable plunger 215 through the peripheral flange portion 216, passes through the gap g1 between the peripheral flange portion 216 and upper magnetic yoke 210, and reaches the upper magnetic yoke 210, as shown in FIG. 5A. A closed magnetic circuit is formed from the upper magnetic yoke 210, through the U-shaped magnetic yoke 201 and through the cylindrical auxiliary yoke 203, to the movable plunger 215.

Because of this, it is possible to increase the magnetic flux density of the gap g1 between the lower surface of the peripheral flange portion 216 of the movable plunger 215 and the upper surface of the upper magnetic yoke 210, a larger suctioning force is generated, and the movable plunger 215 is caused to descend against the biasing force of the return spring 214 and the suctioning force of the permanent magnet 220.

Consequently, the contact portions 130*a* of the movable contact 130 coupled to the movable plunger 215 via the coupling shaft 131 contact the contact portions 118*a* of the fixed contacts 111 and 112, and a current path is formed from the fixed contact 111, through the movable contact 130, toward the fixed contact 112, creating an engaged state.

Figure 5B:
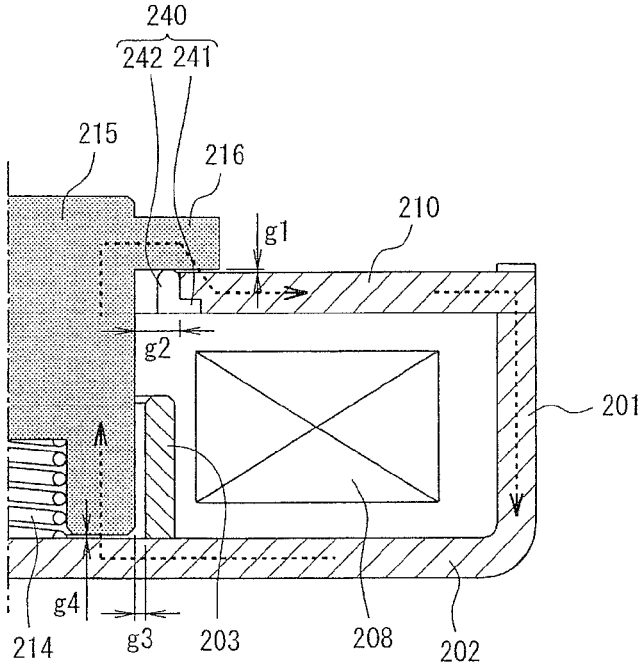

As the lower end surface of the movable plunger 215 nears the bottom plate portion 202 of the U-shaped magnetic yoke 201 in the engaged state, as shown in FIG. 5B, the gaps g1 to g4 are set as below.

$$g1<g2 \text{ and } g3>g4$$

Because of this, the magnetic flux generated by the exciting coil 208 passes from the movable plunger 215 through the peripheral flange portion 216, and enters the upper magnetic yoke 210 directly, as shown in FIG. 5B, while a closed magnetic circuit is formed from the upper magnetic yoke 210, through the U-shaped magnetic yoke 201, returning from the bottom plate portion 202 of the U-shaped magnetic yoke 201 directly to the movable plunger 215.

Because of this, a large suctioning force acts in the gap g1 and gap g4, and the movable plunger 215 is held in the down position. Because of this, the state wherein the contact portions 130*a* of the movable contact 130 coupled to the movable plunger 215 via the coupling shaft 213 contact the contact portions 118*a* of the fixed contacts 111 and 112 is continued.

Further, the movable plunger 215 is covered with a cap 230 formed in a bottomed tubular form made of a non-magnetic body, and a flange portion 231 formed extending outward in a radial direction on an opened end of the cap 230 is seal-joined to the lower surface of the upper magnetic yoke 210. Thereby, a hermetic receptacle, wherein the arc extinguishing chamber 102 and cap 230 communicate via the through hole 210*a* of the upper magnetic yoke 210, is formed.

Further, a gas such as hydrogen gas, nitrogen gas, a mixed gas of hydrogen and nitrogen, air, or $SF_6$ is encapsulated inside the hermetic receptacle formed by the arc extinguishing chamber 102 and cap 230.

Also, when the exciting coil 208 is excited, and moving the movable plunger 215 against the return spring 214 from the released position shown in FIG. 5A to the engaged position shown in FIG. 5B, the lower surface of the peripheral flange portion 216 of the movable plunger 215 contacts the upper magnetic yoke 210.

Because of this, the contact noise suppression member 240, formed of an elastic body that prevents an emission of contact noise when adopting the engaged position, is disposed inside the through hole 210*a* of the upper magnetic yoke 210.

Figure 6:
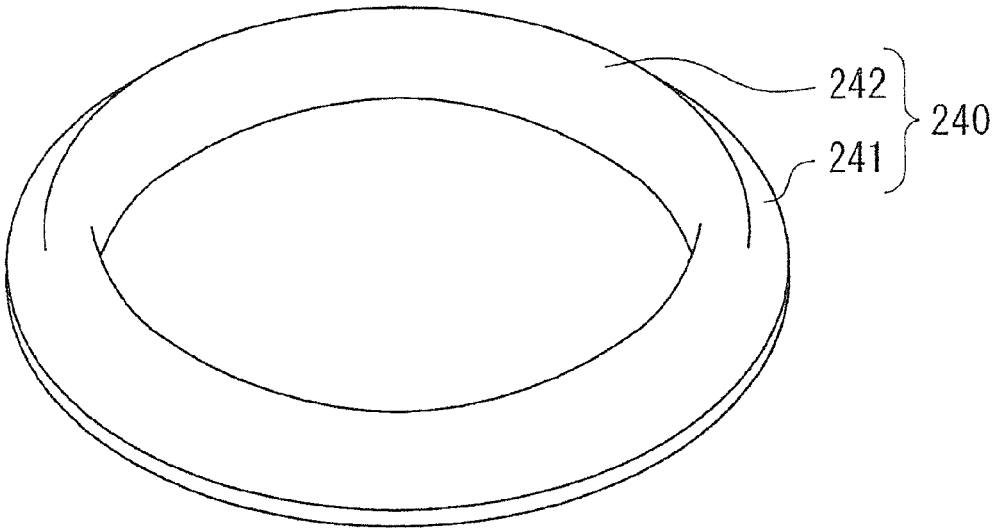
FIG. 6 is a perspective view showing an example of a contact noise suppression member that may be applied to the invention.

The contact noise suppression member 240, as shown in FIG. 6, includes an annular plate portion 241 supported by the flange portion 231 of the cap 230, and a cylinder portion 242, protruding upward from an inner peripheral edge side of the annular plate portion 241 and the upper end thereof protruding by a slight height h from the upper surface of the upper magnetic yoke 210. Herein, a cross-section of the upper end of the cylinder portion 242 is formed in a semi-circular form, as shown in FIG. 4 and FIG. 5. Because of this, when the movable plunger 215 is moved against the return spring 214 from the released position to the engaged position, the lower surface of the peripheral flange portion 216 of the movable plunger 215 contacts the upper surface of the cylinder portion 242 of the contact noise suppression member 240. Because of this, it is possible to reliably suppress an emission of contact noise.

Next, a description will be given of an operation of the heretofore described embodiment.

Herein, it is assumed that the fixed contact 111 is connected to, for example, a power supply source that supplies a large current, while the fixed contact 112 is connected to a load.

In this state, the exciting coil 208 in the electromagnet unit 200 is in a non-excited state, and is in a released state wherein no exciting force causing the movable plunger 215 to descend is being generated in the electromagnet unit 200. In this released state, the movable plunger 215 is biased in an upward direction away from the upper magnetic yoke 210 by the return spring 214.

Simultaneously with this, a suctioning force created by the magnetic force of the permanent magnet 220 acts on the auxiliary yoke 225, and the peripheral flange portion 216 of the movable plunger 215 is suctioned. Because of this, the upper surface of the peripheral flange portion 216 of the movable plunger 215 contacts the lower surface of the auxiliary yoke 225.

Consequently, the contact portions 130*a* of the movable contact 130 of the contact mechanism 101 coupled to the movable plunger 215 via the coupling shaft 131 are separated by a predetermined distance upward from the contact portions 118*a* of the fixed contacts 111 and 112. Because of this, the current path between the fixed contacts 111 and 112 is in an interrupted state, and the contact mechanism 101 is in an opened contact state.

In this way, as the biasing force of the return spring 214 and the suctioning force of the ring-form permanent magnet 220 both act on the movable plunger 215 in the released state, there is no unplanned downward movement of the movable plunger 215 due to external vibration, shock, or the like, and it is thus possible to reliably prevent malfunction.

On the exciting coil 208 of the electromagnet unit 200 excited in the released state, an exciting force is generated in the electromagnet unit 200, and the movable plunger 215 is pressed downward against the biasing force of the return spring 214 and the suctioning force of the ring-form permanent magnet 220.

At this time, as shown in FIG. 5A, the gap g4 between the bottom surface of the movable plunger 215 and the bottom plate portion 202 of the magnetic yoke 201 is large, and hardly any magnetic flux passes through the gap g4. However, the cylindrical auxiliary yoke 203 faces the lower outer peripheral surface of the movable plunger 215, and the gap g3 between the movable plunger 215 and the cylindrical auxiliary yoke 203 is set to be small in comparison with the gap g4.

Because of this, a magnetic path passing through the cylindrical auxiliary yoke 203 is formed between the movable plunger 215 and the bottom plate portion 202 of the magnetic yoke 201. Furthermore, the gap g1 between the lower surface of the peripheral flange portion 216 of the movable plunger 215 and the upper magnetic yoke 210 is set to be small in comparison with the gap g2 between the outer peripheral surface of the movable plunger 215 and the inner peripheral surface of the through hole 210*a* of the upper magnetic yoke 210. Because of this, the magnetic flux density between the lower surface of the peripheral flange portion 216 of the movable plunger 215 and the upper surface of the upper magnetic yoke 210 increases, and a large suctioning force acts, suctioning the peripheral flange portion 216 of the movable plunger 215.

Consequently, the movable plunger 215 descends swiftly against the biasing force of the return spring 214 and the suctioning force of the ring-form permanent magnet 220. Because of this, the descent of the movable plunger 215 is stopped by the lower surface of the peripheral flange portion 216 contacting the upper surface of the cylinder portion 242 of the contact noise suppression member 240, as shown in FIG. 5B.

In this way, when moving from a released position to an engaged position, the peripheral flange portion 216 of the movable plunger 215 is stopped by contacting the contact noise suppression member 240, which is formed of an elastic body. Because of this, there is no emission of a loud contact noise, as the case when the peripheral flange portion 216 of the movable plunger 215 directly contacts the metal upper magnetic yoke 210, and it is possible to ensure quietness.

Further, as the movable plunger 215 descends, the movable contact 130 coupled to the movable plunger 215 via the coupling shaft 131 also descends, and the contact portions 130*a* of the movable contact 130 contacts the contact portions 118*a* of the fixed contacts 111 and 112 with the contact pressure of the contact spring 134.

Because of this, it comes to a closed contact condition wherein the large current of the external power supply source is supplied via the fixed contact 111, the movable contact 130, and the fixed contact 112 to the load.

At this time, an electromagnetic repulsion force is generated between the fixed contacts 111 and 112 and the movable contact 130 in a direction opening the contacts of the movable contact 130.

However, each of the fixed contacts 111 and 112 includes the C-shaped portion 115 having the upper plate portion 116, intermediate plate portion 117, and lower plate portion 118, as shown in FIG. 1. Because of this, the current in the upper plate portion 116 and lower plate portion 118 and the current in the opposing movable contact 130 flow in opposite directions.

Because of this, from the relationship between a magnetic field formed by the lower plate portions 118 of the fixed contacts 111 and 112 and the current flowing through the movable contact 130, it is possible, in accordance with Fleming's left-hand rule, to generate a Lorentz force that presses the movable contact 130 against the contact portions 118*a* of the fixed contacts 111 and 112.

Because of this Lorentz force, it is possible to oppose the electromagnetic repulsion force generated in the contact opening direction between the contact portions 118*a* of the fixed contacts 111 and 112 and the contact portions 130*a* of the movable contact 130, and thus possible to reliably prevent the contact portions 130*a* of the movable contact 130 from opening.

Because of this, it is possible to reduce the pressing force of the contact spring 134 supporting the movable contact 130, and also possible to reduce thrust generated in the exciting coil 208 in response to the pressing force, and it is thus possible to reduce the size of the overall configuration of the electromagnetic contactor.

When interrupting the supply of current to the load in the closed contact state of the contact mechanism 101, the exciting of the exciting coil 208 of the electromagnet unit 200 is stopped.

Because of this, there is no longer an exciting force causing the movable plunger 215 to move downward in the electromagnet unit 200, thereby, the movable plunger 215 is raised by the biasing force of the return spring 214, and as the peripheral flange portion 216 comes close to the auxiliary yoke 225, the suctioning force of the ring-form permanent magnet 220 increases.

As the movable plunger 215 rises, the movable contact 130 coupled via the coupling shaft 131 rises. As a result, the movable contact 130 contacts the fixed contacts 111 and 112 while contact pressure is applied by the contact spring 134. Subsequently, it comes to an opened contact state, wherein the movable contact 130 moves upward from the fixed contacts 111 and 112 when the contact pressure of the contact spring 134 stops.

When the opened contact state starts, an arc is generated between the contact portions 118*a* of the fixed contacts 111 and 112 and the contact portions 130*a* of the movable contact 130, and the state in which current is conducted is continued due to the arc.

At this time, as the insulating cover 121 covering the upper plate portion 116 and intermediate plate portion 117 of the C-shaped portion 115 of each of the fixed contacts 111 and 112, is mounted, it is possible to cause the arc to be generated only between the contact portions 118*a* of the fixed contacts 111 and 112 and the contact portions 130*a* of the movable contact 130. Because of this, it is possible to stabilize the arc generation state, and thus possible to improve arc extinguishing performance.

Also, as the upper plate portion 116 and intermediate plate portion 117 of the C-shaped portion 115 are covered by the insulating cover 121, it is possible to maintain insulating distance with the insulating cover 121 between the two end portions of the movable contact 130 and the upper plate portion 116 and intermediate plate portion 117 of the C-shaped portion 115, and thus possible to reduce the height in the direction in which the movable contact 130 can move. Consequently, it is possible to reduce the size of the contact device 100.

Furthermore, as the inner surface of the intermediate plate portion 117 of each of the fixed contacts 111 and 112 is covered by the magnetic plate 119, a magnetic field generated by current flowing through the intermediate plate portion 117 is shielded by the magnetic plate 119. Because of this, there is no interference between a magnetic field caused by the arc generated between the contact portions 118*a* of the fixed contacts 111 and 112 and the contact portions 130*a* of the movable contact 130 and the magnetic field generated by the current flowing through the intermediate plate portion 117, and it is thus possible to prevent the arc being affected by the magnetic field generated by the current flowing through the intermediate plate portion 117.

According to the first embodiment, when the movable plunger 215 reaches the engaged position from the released position against the return spring 214 in this way, it is possible to reliably prevent an emission of contact noise by the peripheral flange portion 216 of the movable plunger 215 contacting the contact noise suppression member 240.

In this case, it is possible to reliably prevent an emission of contact noise with a simple configuration wherein the contact noise suppression member 240 is formed of only the annular plate portion 241 and cylinder portion 242.

Also, with regard to the electromagnet unit 200, the ring-form permanent magnet 220 magnetized in the direction in which the movable plunger 215 can move is disposed on the upper magnetic yoke 210, and the auxiliary yoke 225 is formed on the upper surface of the ring-form permanent magnet 220, thereby, it is possible to generate suctioning force that suctions the peripheral flange portion 216 of the movable plunger 215 with the one ring-form permanent magnet 220.

Because of this, it is possible to carry out the fixing of the movable plunger 215 in the released state with the magnetic force of the ring-form permanent magnet 220 and the biasing force of the return spring 214, thereby, it is possible to improve holding force with respect to malfunction shock.

Also, it is possible to reduce the biasing force of the return spring 214, and thus possible to reduce the total load of the contact spring 134 and return spring 214. Consequently, it is possible to reduce the suctioning force generated in the exciting coil 208 in accordance with the amount by which the total load is reduced, and thus possible to reduce the magnetomotive force of the exciting coil 208. Because of this, it is possible to reduce the length in the axial direction of the spool 204, and thus possible to reduce the height of the electromagnet unit 200 in the direction in which the movable plunger 215 can move.

As it is possible to reduce the height in the direction in which the movable plunger 215 can move in both the contact device 100 and electromagnet unit 200 in this way, it is possible to considerably shorten the overall configuration of the electromagnetic contactor 10, and thus possible to achieve a reduction in size.

Furthermore, due to the peripheral flange portion 216 of the movable plunger 215 disposed inside the inner peripheral surface of the ring-form permanent magnet 220, there is no waste in a closed circuit passing magnetic flux emitted from the ring-form permanent magnet 220, and the leakage flux decreases, thereby, it is possible to use the magnetic force of the permanent magnet effectively.

Also, as the peripheral flange portion 216 of the movable plunger 215 is disposed between the upper magnetic yoke 210 and the auxiliary yoke 225 formed on the upper surface of the ring-form permanent magnet 220, it is possible to regulate the stroke of the movable plunger 215 with the thickness of the ring-form permanent magnet 220 and the thickness of the peripheral flange portion 216 of the movable plunger 215.

Because of this, it is possible to reduce the cumulative number of parts and to minimize form tolerance, affecting the stroke of the movable plunger 215. Moreover, as the regulation of the stroke of the movable plunger 215 is carried out with only the thickness of the ring-form permanent magnet 220 and the thickness of the peripheral flange portion 216 of the movable plunger 215, it is possible to minimize variation of the stroke.

In the first embodiment, a description has been given of a case wherein the contact noise suppression member 240 includes the annular plate portion 241 and cylinder portion 242, but the invention is not limited to this, and the contact noise suppression member 240 can be formed of only the cylinder portion 242.

Figure 7:
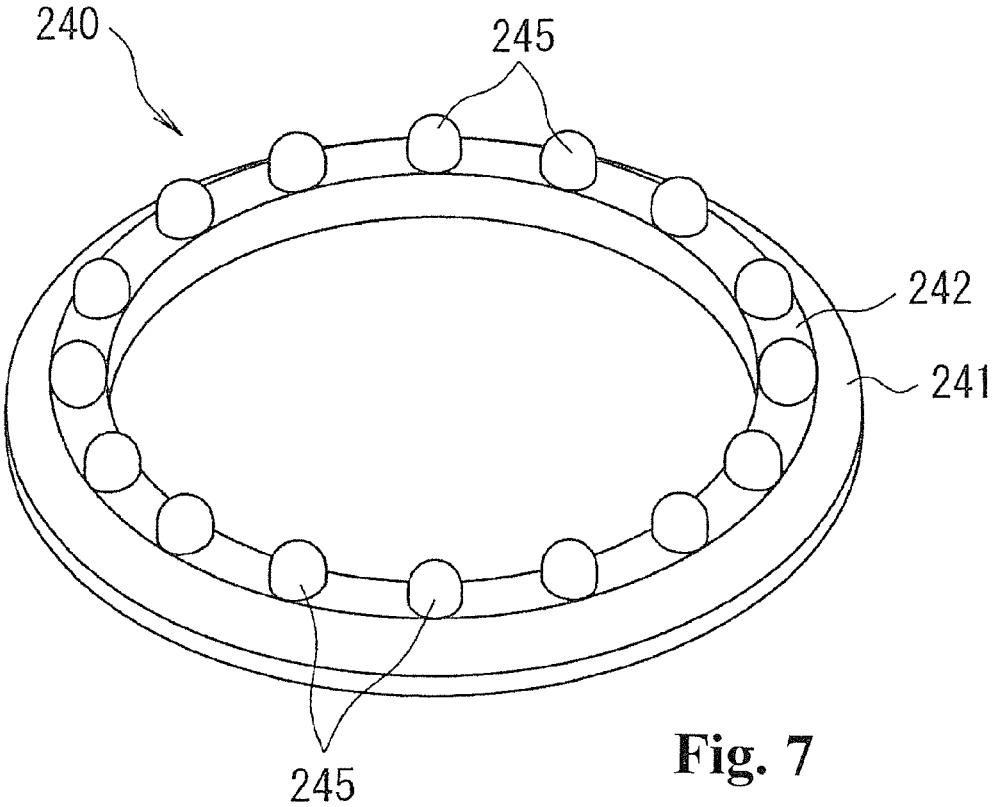
FIG. 7 is a perspective view showing a modification example of the contact noise suppression member.

Also, in the first embodiment, a description has been given of a case wherein the surface of the contact noise suppression member 240 that contacts the lower surface of the peripheral flange portion 216 of the movable plunger 215 is formed in an annular form, but the invention is not limited to this. That is, the invention is such that the contact noise suppression member 240, not being limited to the heretofore described configuration, may be such that, for example, 20 columnar protruding portions 245 are formed to maintain predetermined intervals in a circumferential direction on the upper surface side of the cylinder portion 242 forming the surface that contacts the peripheral flange portion 216 of the movable plunger 215, as shown in FIG. 7. In this case, as the columnar protruding portions 245 are disposed to maintain predetermined intervals, it is possible to more reliably prevent an emission of contact noise by reducing the elastic coefficient of the protruding portions 245 themselves, and making them more easily compressed.

Next, based on FIG. 8, a description will be given of a second embodiment of the invention.

In the second embodiment, instead of the case wherein a contact noise suppression member directly contacts the peripheral flange portion of the movable plunger, contact noise when reaching an engaged position from a released position is indirectly suppressed.

Figure 8A:
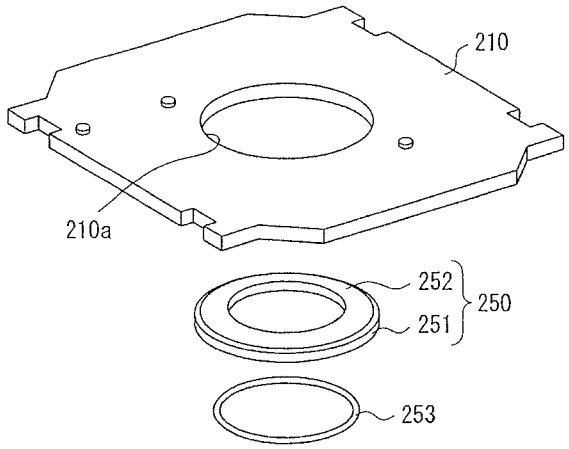
Figure 8B:
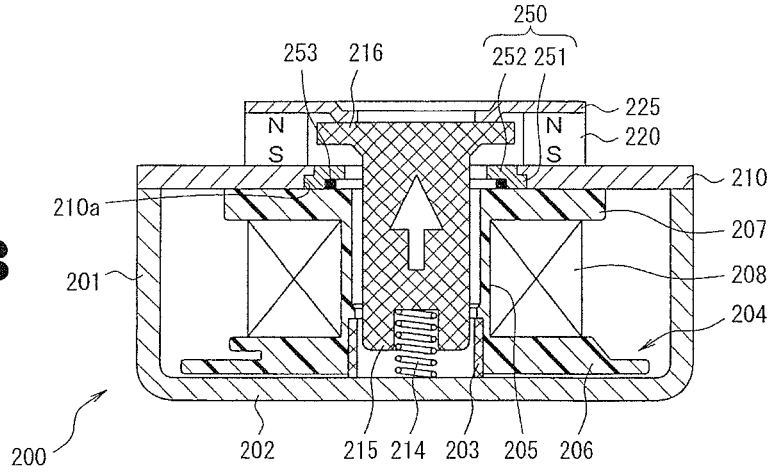
Figure 8C:
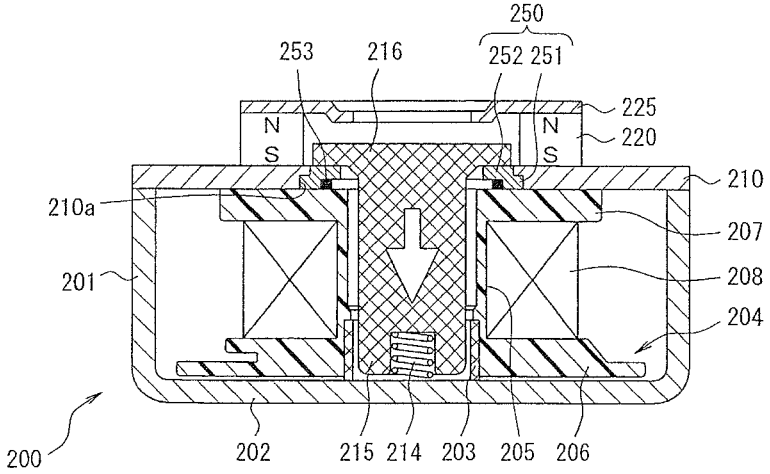

That is, in the second embodiment, the contact noise suppression member 240 of the first embodiment is omitted, and instead of the contact noise suppression member 240, an engaged position regulating member 250 that regulates the engaged position of the movable plunger 215 is disposed on a stepped portion 210*b* formed inside the through hole 210*a* of the upper magnetic yoke 210 so as to be slightly slidable in the axial direction, as shown in FIGS. 8A to 8C.

The engaged position regulating member 250 is formed in a sectional crank form of a lower annular plate portion 251, spaced with a predetermined gap from the stepped portion 210*b* formed in the through hole 210*a*, and an upper annular plate portion 252, displaced upward from the inner peripheral edge of the lower annular plate portion 251 and extending inward.

Further, an elastic ring 253 of circular cross-section, acting as a contact noise suppression member formed of, for example, an O-ring whose diameter is selected to be longer than the distance from the bottom surface of the lower annular plate portion 251 to the lower surface of the upper annular plate portion 252, is disposed in a position enclosed by the inner peripheral surface of the lower annular plate portion 251 and the lower surface of the upper annular plate portion 252.

Consequently, the engaged position regulating member 250 is disposed slightly upward of the lower surface of the upper magnetic yoke 210 due to the elastic ring 253.

Although not shown in FIGS. 8B and 8C, the cap 230 covering the movable plunger 215 is provided in the same way as in the first embodiment.

According to the second embodiment, it is possible to obtain the same operation as in the first embodiment. That is, as shown in FIG. 8B, the movable plunger 215 is biased by the return spring 214, and is in a released position wherein the upper surface of the peripheral flange portion 216 of the movable plunger 215 contacts the auxiliary yoke 225 fixed to the upper surface of the permanent magnet 220.

When the exciting coil 208 is energized with the movable plunger 215 in the released position, the movable plunger 215 descends to an engaged position against the return spring 214, in the same way as in the first embodiment.

Further, immediately before reaching the engaged condition, the movable plunger 215 contacts the engaged position regulating member 250, as shown in FIG. 8C. At this time, the engaged position regulating member 250 is elastically supported by the elastic ring 253. Because of this, when the lower surface of the peripheral flange portion 216 of the movable plunger 215 contacts the upper annular plate portion 252, the engaged position regulating member 250 escapes downward due to the elasticity of the elastic ring 253. Consequently, even when the peripheral flange portion 216 of the movable plunger 215 contacts the engaged position regulating member 250, it is possible to suppress an emission of a loud contact noise.

In the second embodiment, a description has been given of a case wherein the engaged position regulating member 250 is formed such that the upper annular plate portion 252 is disposed on the inner side, but the invention is not limited to this, and the engaged position regulating member 250 may be formed such that a lower annular plate portion is formed on the inner side, an upper annular plate portion is formed on the outer side, and the elastic ring 253 is disposed between the upper annular plate portion and the flange portion 231 of the cap 230.

Also, in the second embodiment, a description has been given of a case wherein the engaged position regulating member 250 is formed in an annular form, but the invention is not limited to this, and the engaged position regulating member 250 can also be formed in a rectangular ring form or polygonal ring form. It is sufficient that the form of the peripheral flange portion 216 of the movable plunger 215 is changed accordingly.

Next, based on FIG. 9, a description will be given of a third embodiment of the invention.

In the third embodiment, in addition to a case of suppressing contact noise when adopting an engaged position, as the first and second embodiments, contact noise when changing from an engaged position to a released position is also suppressed.

Figure 9A:
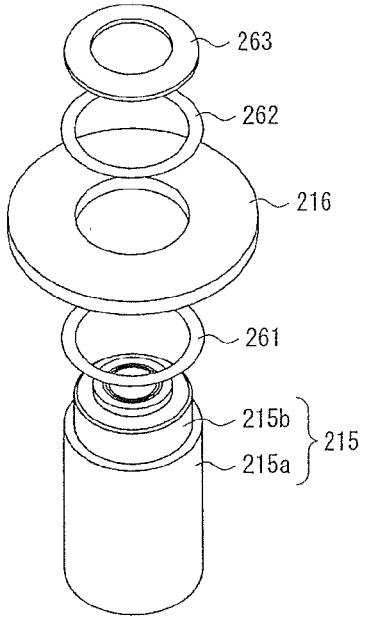

That is, in the third embodiment, the peripheral flange portion 216 of the movable plunger 215 is formed as a separate body, as shown in FIG. 9A. The peripheral flange portion 216 is slidably engaged in an axial direction on a small diameter portion 215*b* having a diameter slightly smaller than a large diameter portion 215*a*, which has a diameter slightly smaller than the inner diameter of the lower cap 230, formed on the upper side of the movable plunger 215 above the flange portion 231 of the cap 230. Further, a lower side elastic ring 261 and upper side elastic ring 262 formed of, for example, O-rings acting as contact noise suppression members are disposed on two end portions of the peripheral flange portion 216 in an axial direction, the lower side elastic ring 261 contacts a stepped portion between the large diameter portion 215*a* and small diameter portion 215*b*, and the upper side elastic ring 262 contacts a washer 263 fitted on the upper end of the movable plunger 215.

Consequently, the peripheral flange portion 216 is disposed between the stepped portion between the large diameter portion 215*a* and small diameter portion 215*b* of the movable plunger 215 and the washer 263 across the lower side elastic ring 261 and upper side elastic ring 262.

According to the third embodiment, the peripheral flange portion 216 is separated from the movable plunger 215, and the separated peripheral flange portion 216 is fixed to the movable plunger 215 across the elastic rings 261 and 262 on two ends in the axial direction.

Figure 9B:
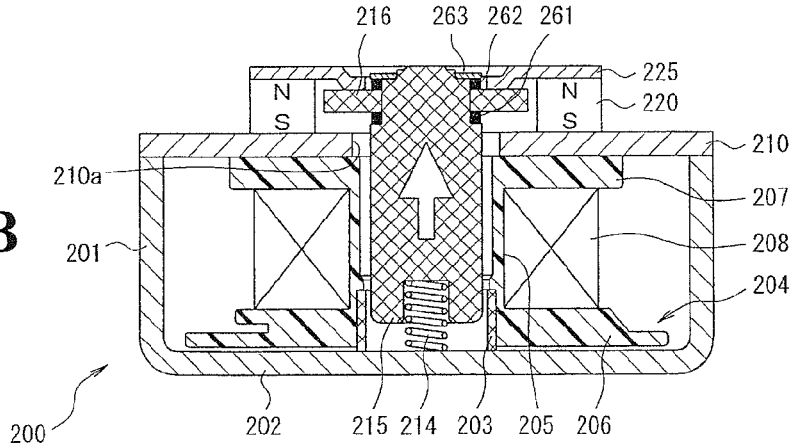
Figure 9C:
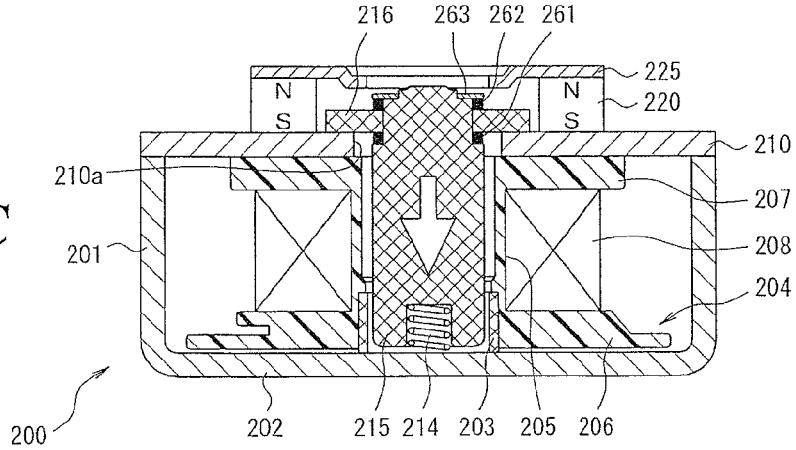

Because of this, from a state wherein the movable plunger 215 is biased by the return spring 214 and placed in the released position, as shown in FIG. 9B, the exciting coil 208 is energized, causing the movable plunger 215 to descend against the return spring 214 and move to an engaged position. At this time, immediately before the movable plunger 215 reaches the engaged position, the lower surface of the peripheral flange portion 216 contacts the upper surface of the upper magnetic yoke 210.

However, as the peripheral flange portion 216 is supported across the upper elastic ring 262 by the washer 263, the upper elastic ring 262 elastically deforms, and the peripheral flange portion 216 escapes upward. Consequently, it is possible, with the upper elastic ring 262, to suppress contact noise when the peripheral flange portion 216 and upper surface of the upper magnetic yoke 210 contact each other.

When stopping the energizing of the exciting coil 208 in the engaged state, the movable plunger 215 moves upward due to the biasing force of the return spring 214, the suctioning force of the permanent magnet 220 is also applied when the movable plunger 215 nears the released position above, and the upper end of the peripheral flange portion 216 swiftly contacts the auxiliary yoke 225 fixed to the upper end of the permanent magnet 220.

In the released position, as shown in FIG. 9B, when the upper surface of the peripheral flange portion 216 contacts the auxiliary yoke 225 fixed to the upper end of the permanent magnet 220, the peripheral flange portion 216 contacts the stepped portion between the large diameter portion 215*a* and small diameter portion 215*b* of the movable plunger 215 across the lower elastic ring 261. Because of this, the peripheral flange portion 216 escapes downward due to the elastic deformation of the lower elastic ring 261, thereby, it is possible to suppress an emission of contact noise when the peripheral flange portion 216 contacts the lower surface of the auxiliary yoke 225.

In this way, in the third embodiment, it is possible, with the upper elastic ring 262 and lower elastic ring 261, to sufficiently suppress contact noise emitted when the peripheral flange portion 216 contacts the upper magnetic yoke 210 and auxiliary yoke 225, both when the movable plunger 215 reaches an engaged position from a released position and when the movable plunger 215 reaches a released position from an engaged position.

In the third embodiment, a description has been given of a case wherein the movable plunger 215 is formed in a columnar form, and the inner peripheral surfaces of the elastic rings 261 and 262 and peripheral flange portion 216 are formed as cylinder surfaces, but the invention is not limited to this, and the sectional form of the movable plunger 215 on which the peripheral flange portion 216 is engaged can be an arbitrary form, such as rectangular or polygonal, in accordance with the form, the inner peripheral surfaces of the elastic rings 261 and 262 and peripheral flange portion 216 can be of a form tailored to the sectional form of the movable plunger 215.

In the first to third embodiments, the configuration of the contact device 100 is not limited to the heretofore described configuration, and can be an arbitrary configuration.

Also, in the embodiments, a description has been given of a case wherein the coupling shaft 131 is screwed to the movable plunger 215, but this is not limited to screwing, and it is possible to apply an arbitrary connection method, and furthermore, the movable plunger 215 and coupling shaft 131 may also be formed integrally.

Also, in the embodiments, a description has been given of a case wherein a hermetic receptacle includes the arc extinguishing chamber 102 and cap 230, and gas is encapsulated inside the hermetic receptacle, but the invention is not limited to this, and the gas encapsulation may be omitted when the interrupted current is small.

INDUSTRIAL APPLICABILITY

According to the invention, it is possible to provide an electromagnetic contactor such that it is possible to suppress an emission of contact noise at least when a movable plunger moves a contact mechanism to an engaged position, thus improving quietness.

REFERENCE SIGNS LIST

10 . . . Electromagnetic contactor, 100 . . . Contact device, 101 . . . Contact mechanism, 102 . . . Arc extinguishing chamber, 104 . . . Tubular body, 111, 112 . . . Fixed contact, 114 . . . Support conductor portion, 115 . . . C-shaped portion, 116 . . . Upper plate portion, 117 . . . Intermediate plate portion, 118 . . . Lower plate portion, 118*a* . . . Contact portion, 121 . . . Insulating cover, 122 . . . L-shaped plate portion, 123, 124 . . . Side plate portion, 125 . . . Fitting portion, 130 . . . Movable contact, 130*a* . . . Contact portion, 131 . . . Coupling shaft, 132 . . . Depressed portion, 134 . . . Contact spring, 140 . . . Insulating cylinder, 160 . . . L-shaped portion, 200 . . . Electromagnet unit, 201 . . . Magnetic yoke, 203 . . . Cylindrical auxiliary yoke, 204 . . . Spool, 208 . . . Exciting coil, 210 . . . Upper magnetic yoke, 214 . . . Return spring, 215 . . . Movable plunger, 216 . . . Peripheral flange portion, 220 . . . Permanent magnet, 225 . . . Auxiliary yoke, 230 . . . Cap, 240 . . . Contact noise suppression member, 241 . . . Annular plate portion, 242 . . . Cylinder portion, 250 . . . Engaged position regulating member, 253 . . . Elastic ring, 261 . . . Lower elastic ring, 262 . . . Upper elastic ring, 263 . . . Washer

What is claimed is:

1. An electromagnetic contactor, comprising:

a contact mechanism including a pair of fixed contacts disposed to maintain a predetermined interval and a movable contact disposed so as to connect to and separate from the pair of fixed contacts; and an electromagnet unit that drives the movable contact, the electromagnet unit including:

a plunger drive portion, a magnetic yoke enclosing the plunger drive portion, a movable plunger having a leading end protruding through an aperture formed in the magnetic yoke and a peripheral flange portion formed at the leading end, a movement regulating portion including the magnetic yoke, an auxiliary yoke disposed above the magnetic yoke and sandwiching the peripheral flange portion with the magnetic yoke, and a permanent magnet sandwiched between the magnetic yoke and the auxiliary yoke, and regulating movement of the peripheral flange portion of the movable plunger in an engaged position and released position of the contact mechanism, and a contact noise suppression member that suppresses contact noise when the peripheral flange portion of the movable plunger contacts the movement regulating portion.

2. The electromagnetic contactor according to claim 1, wherein the contact noise suppression member includes an elastic body disposed in the movement regulating portion and contacting the peripheral flange portion of the movable plunger.

3. The electromagnetic contactor according to claim 2, wherein the elastic body is disposed in a ring form inside the aperture formed in the magnetic yoke.

4. The electromagnetic contactor according to claim 1, wherein the contact noise suppression member includes a movement regulating plate slidably disposed in an axial direction inside the aperture of the magnetic yoke, a fixed member formed in a sectional crank form with the movement regulating plate and regulating a position of the movement regulating plate in the axial direction, and an elastic body interposed between the movement regulating plate and the fixed member.

5. The electromagnetic contactor according to claim 4, wherein the aperture of the magnetic yoke has a stepped portion;

the fixed member is disposed inside the stepped portion, and the movement regulating plate extends inwardly above a part of the fixed member to displace from an inner peripheral edge of the fixed member; and the elastic body is disposed on an area enclosed by a lower surface of the movement regulating plate and the inner peripheral edge of the fixed member.

6. The electromagnetic contactor according to claim 1, wherein the contact noise suppression member is arranged in the aperture inside the permanent magnet, and has an upper end positioned higher than the magnetic yoke to contact the peripheral flange portion.

7. An electromagnetic contactor, comprising:

a contact mechanism including a pair of fixed contacts disposed to maintain a predetermined interval and a movable contact disposed so as to connect to and separate from the pair of fixed contacts; and an electromagnet unit that drives the movable contact, the electromagnet unit including:

a magnetic yoke enclosing a plunger drive portion, a movable plunger having a leading end protruding through an aperture formed in the magnetic yoke and a peripheral flange portion formed on a protruding end side thereof, a movement regulating portion that regulates movement of the peripheral flange portion of the movable plunger in an engaged position and released position of the contact mechanism, and a contact noise suppression member that suppresses contact noise when the peripheral flange portion of the movable plunger contacts the movement regulating portion, wherein the contact noise suppression member includes an elastic body disposed in the movement regulating portion and contacting the peripheral flange portion of the movable plunger, and the elastic body has protruding portions disposed to maintain predetermined intervals in a circumferential direction on a surface that contacts the peripheral flange portion of the movable plunger.

8. An electromagnetic contactor, comprising:

a contact mechanism including a pair of fixed contacts disposed to maintain a predetermined interval and a movable contact disposed so as to connect to and separate from the pair of fixed contacts; and an electromagnet unit that drives the movable contact, the electromagnet unit including:

a magnetic yoke enclosing a plunger drive portion, a movable plunger having a leading end protruding through an aperture formed in the magnetic yoke and a peripheral flange portion formed on a protruding end side thereof, a movement regulating portion that regulates movement of the peripheral flange portion of the movable plunger in an engaged position and released position of the contact mechanism, and a contact noise suppression member that suppresses contact noise when the peripheral flange portion of the movable plunger contacts the movement regulating portion, wherein the movable plunger is arranged such that the peripheral flange portion is disposed so as to be movable in an axial direction, and the contact noise suppression member includes elastic rings that individually support two ends of the peripheral flange portion in the axial direction.

* * * * *